United States Patent [19]

Meyer

[11] 3,988,031

[45] Oct. 26, 1976

[54] MULTIPLE PADLOCK DEVICE

[76] Inventor: Gordon R. Meyer, Rte. 1, Box 7, Cotulla, Tex. 78014

[22] Filed: Mar. 22, 1976

[21] Appl. No.: 668,712

[52] U.S. Cl. ..... 292/153; 70/134; 70/DIG. 63; 292/148; 292/205

[51] Int. Cl.[2] ..... E05C 1/04

[58] Field of Search ..... 292/148, 150, 153, 205, 292/341.15, 341.17, DIG. 18; 70/129, 134, DIG. 63

[56] References Cited

UNITED STATES PATENTS

| | | | |
|---|---|---|---|
| 1,008,220 | 11/1911 | Tullis | 292/205 X |
| 1,260,469 | 3/1918 | Smith | 292/148 X |
| 1,302,896 | 5/1919 | Burgess | 292/341.15 |
| 1,391,357 | 9/1921 | Baer | 70/129 X |
| 1,961,041 | 5/1934 | Gilbert | 292/148 |
| 2,525,187 | 10/1950 | Tabler | 292/153 |
| 2,707,125 | 4/1955 | Ritter | 70/DIG. 63 X |
| 3,656,789 | 4/1972 | Ray | 70/DIG. 63 X |
| 3,752,518 | 8/1973 | Gannell | 292/148 X |
| 3,889,497 | 6/1975 | Tuttle | 70/DIG. 63 X |
| 3,937,503 | 2/1976 | Harris | 292/153 |

*Primary Examiner*—Roy D. Frazier
*Assistant Examiner*—Thomas J. Holko
*Attorney, Agent, or Firm*—Cox, Smith, Smith, Hale & Guenther Incorporated

[57] ABSTRACT

This invention relates to a multiple padlocking device commonly used in conjunction with gates for the entrance to a particular piece of property. A vertical rotatable plate is carried on a stationary horizontal axis in the same plane as the fence and gate when the gate is closed. A series of holes are located in the rotatable plate with individual bars being pivotally attached to the plate to cover each respective hole. Locking holes are contained in both the rotatable plate and each pivotable bar contained thereon to lock the bar into a position covering each of the respective holes. A horizontally slidable locking bar which is in the same plane as the gate, slidably extends through a gatepost with one end thereof extending into a hole in a fencepost. The other end of the locking bar is in an abutting relationship with the rotatable plate so that if a pivotal bar is moved to one side, the horizontally slidable locking bar may be extended through a hole in the rotatably plate thereby removing the opposite end from the hole in the fencepost to allow the gate to be opened.

10 Claims, 4 Drawing Figures

MULTIPLE PADLOCK DEVICE

BACKGROUND OF THE INVENTION

This invention relates to a multiple padlocking device and, more particularly, to a multiple padlocking device that may be used for a combination of locks to allow entry through a gate to a particular piece of property by unlocking any one of the multiple locks. This invention is particularly suited for use on gates wherein a large number of individuals may have their own particular lock and key for entry through the gate.

BRIEF DESCRIPTION OF THE PRIOR ART

Prior to the present invention, many different types of locking mechanisms have been used to hold gates in the closed position to prevent unauthorized entry. The most common method used was a chain wrapped around the fencepost and the gatepost and locked in position so that it may be be removed by unauthorized intruders. However, to use a chain wrapped around the fencepost and gatepost with a lock is fairly inconvenient for use by a large number of persons that may be authorized to enter the particular property.

A further consideration that has caused increased concern is the large number of people that may need to enter a particular piece of property, especially large ranches that may have numerous hunting leases, oil leases, and other tenants that need to enter the property. If each person that is authorized to enter the property has a key to the lock, it becomes a very severe problem to insure that only authorized persons have the key. One way to solve the problem is to give each authorized person or groups of persons a separate lock for the gate. Thereafter, if unauthorized persons gain access via a particular lock, or if a formerly authorized person is no longer authorized to enter the premise, that particular lock may be replaced without having to make and distribute new keys for all others persons permitted to enter the premise through the locked gate.

A similar such apparatus was described in Ritter, U.S. Pat. No. 2,707,125, which showed a series of locks used in combination with a gatepost. If one of the locks were removed, an internal portion of the gate could slide upward thereby moving a pin to release a locking bar. The construction of the gate post is fairly complicated and expensive to build. A copy of U.S. Pat. No. 2,707,125 is enclosed herewith for the Examiner.

SUMMARY OF THE INVENTION

It is an object of the present invention to provide a multiple padlocking device to allow entry through a gate by unlocking only one of a number of locks.

It is another object of the present invention to provide a multiple padlocking device having a rotatable plate carried on a stationary axis with a locking bar releasing the gate upon uncovering a single hole in the rotatable plate by removal of a single lock which allows the locking bar to slide therethrough.

It is yet another object of the present invention to provide a multiple padlocking device to allow entry through a gate to a given premise by a large number of individuals, each having their own separate lock, yet without requiring that new keys be given to each individual upon replacement of a single lock.

In the present invention, a rotatable plate is carried on a horizontal stationary axis that may be located on either the gate or the fence to which the gate attaches.

A horizontally slideable locking bar extends through either the fencepost or the gatepost with one end extending into a hole of the other post. The opposite end of the locking bar abutts the rotatable plate in such a manner that if a single hole out of a series of holes in the rotatable plate is uncovered by removing a padlock that holds a pivotal bar mounted on the rotatable plate over the hole, the gate may be opened.

DESCRIPTION OF THE PREFERRED EMBODIMENT

Figure 1:
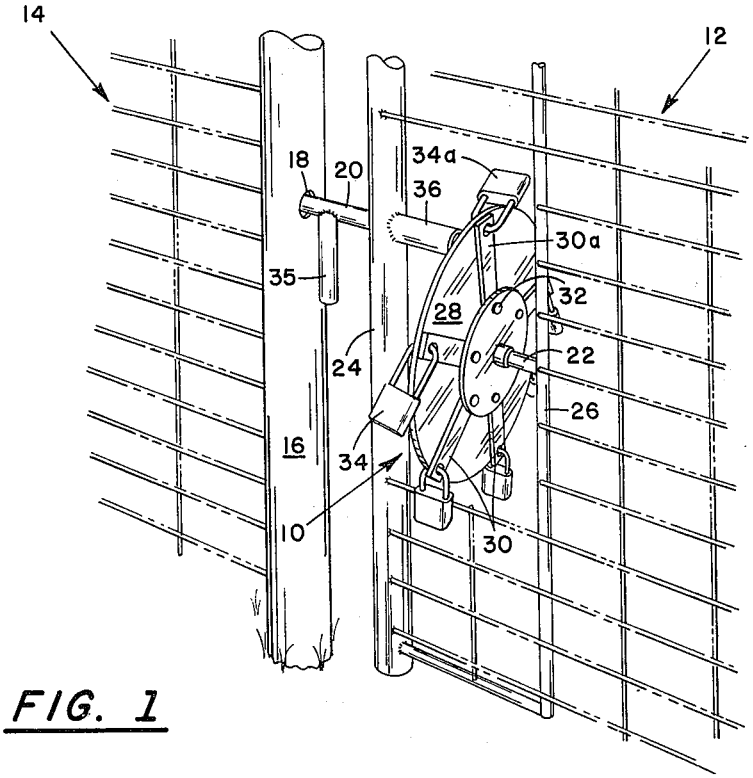
FIG. 1 is a pictorial illustration of a multiple padlocking device locking a gate closed.
Figure 2:
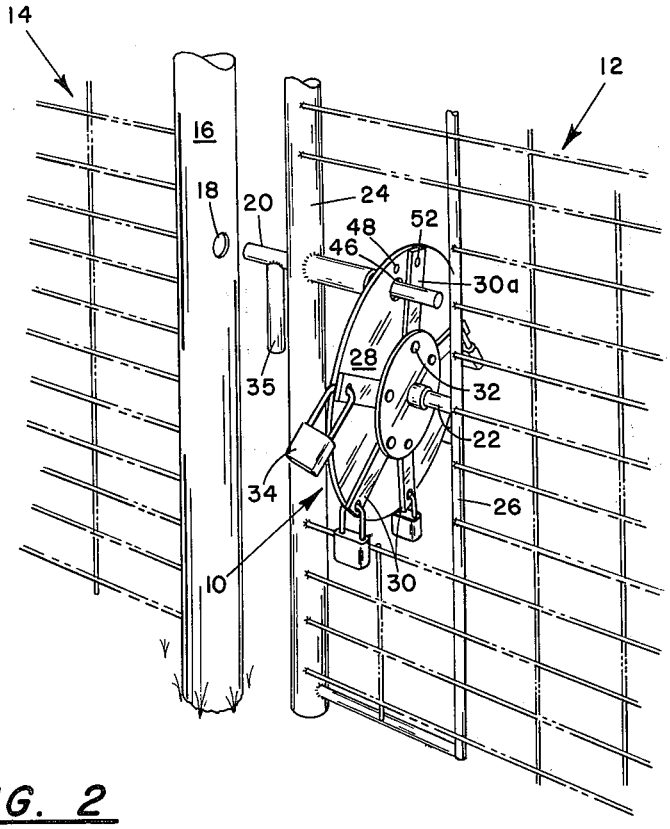
FIG. 2 is a pictorial illustration of the multiple padlocking device with one padlock being removed to allow opening of the gate.

Referring now to FIGS. 1 and 2 of the drawings, there is shown a multiple padlocking device represented generally by the reference numeral 10. The multiple padlocking device 10 is located on gate 12 of fence 14. The fence 14 has a stationary post 16 with a hole 18 therein for receiving horizontally locking bar 20.

On the gate 12 a horizontal stationary axis 22 is secured on one end to a gatepost 24 and on the other end to a vertical bar 26. Pivotally mounted on the horizontal stationary axis 22 is a rotating plate 28. Mounted on the rotating plate 28 are pivotal bars 30 which are pivotally connected on one end by pins 32. The other end of pivotal bars 30 are held into position by padlocks 34.

Figure 3:
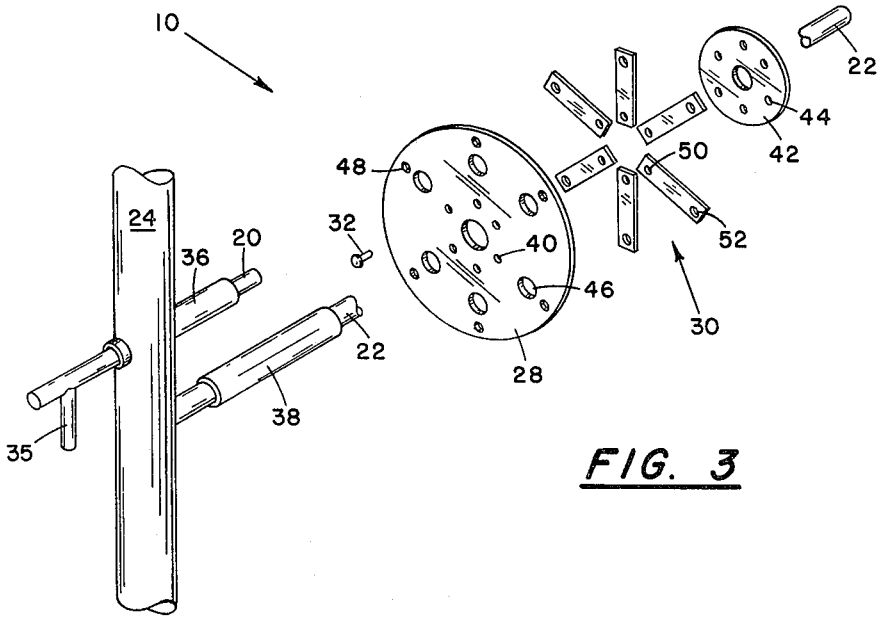
FIG. 3 is an exploded perspective view of the multiple padlocking device.
Figure 4:
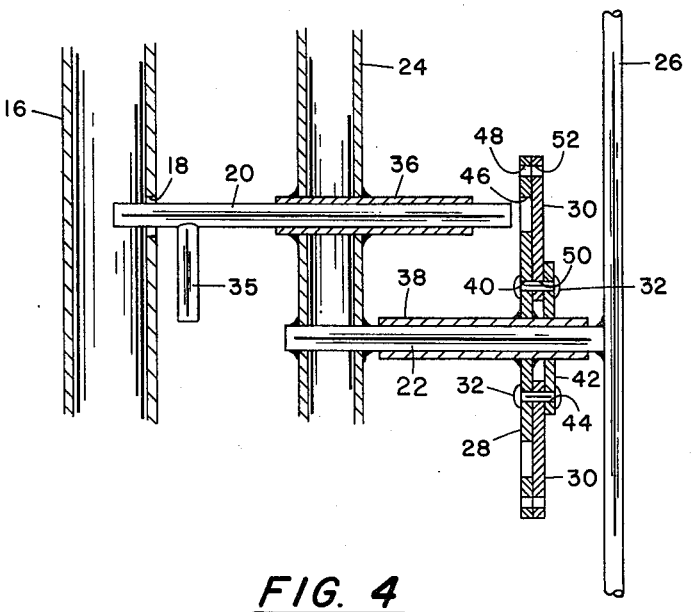
FIG. 4 is a partial sectional view of the multiple padlocking device as connected to a fencepost and gate.

Referring now to FIGS. 3 and 4 in combination, a better understanding of a multiple padlocking device 10 can be obtained. The horizontally slideable bar 20, which may be operated by handle 35, extends through guide sleeve 36 of gatepost 24. The guide sleeve 36 is held into position by any usual manners such as welding to the gatepost 24. Located on the horizontally stationary axis 22, which may also be welded to gatepost 24, is a rotatable sleeve 38. The horizontal stationary axis 22 and rotatable sleeve 38 extend through the center of rotatable plate 28 with the rotatable sleeve 38 being secured to the rotatable plate 28 by any conventional means such as welding.

Referring to the rotatable plate 28, there is a series of three holes along a predetermined number of radii of the rotatable plate 28. In the present case, the predetermined number of radii are shown as 6; however, any particular number may be used as long as that particular number may be accommodated by the particular rotatable plate 28 of the multiple padlocking device 10. The inner-most holes are pivot pin holes 40 for receiving pins 32 to hold pivot bars 30 on the rotatable plate 28. A pivot bar plate 42 also has a series of pivot pin holes 44 for receiving pins 32. While the pivot bar plate 42 may not be essential to the present invention, it helps insure a uniform distribution of force against pivot bars 30. The pins 32 should be bradded on both ends so they cannot be easily removed.

The next holes along the radii of rotatable plate 28 are somewhat larger, called locking bar holes 46, for receiving locking bar 20 when opening the gate 12. Also, along the same radii are the outermost holes, called padlock holes 48, for receiving the padlocks 34 therethrough. Each set of holes 40, 46 and 48 as contained along each radii is a uniform distance from the center of rotatable plate 28.

Each of the pivot bars 30 has an innermost hole 50 for receiving its respective pivot pin 32 therethrough. Also, each pivotal bar 30 has an outermost hole 52 for receiving its respective padlock 34 therethrough.

METHOD OF OPERATION

Referring now to FIG. 1 of the drawings, assume that an authorized individual that has a key to padlock 34*a* wants to enter gate 12. After unlocking padlock 34*a*, it is removed from padlock holes 48 and outermost holes 52 of pivotal bar 30*a*. After the removal of padlock 34*a*, pivotal bar 30*a* may be pivoted to one side as shown in FIG. 2. The pivoting of pivotal bar 30*a* to one side uncovers locking bar hole 46. By rotating the rotatable plate 28 until the uncovered locking bar hole 46 is in line with horizontally slideable locking bar 20, the locking bar 20 may be moved to the right through locking bar hole 46 (see FIG. 2) which removes the locking bar 20 from hole 18 of stationary post 16. Now the gate 12 may be opened. Afterwards, gate 12 may be relocked by the reverse procedure.

Any of the other authorized people to enter through gate 12, that have keys to any other of the padlocks 34, may enter through gate 12 by using the same procedure as hereinabove described. Assume that one of the persons that was previously authorized to enter through gate 12, and was given a key for one of the padlocks, is no longer authorized to enter on the premise through gate 12. The padlock 34 to which the individual has a key may be replaced without having to make and distribute new keys to every other person that has keys to the other padlocks remaining on the rotatable plate 28 of of gate 12. This is particularly important on hunting leases where a large number of persons may have a lease this year, but next year some different individuals may be substituted.

It should be clearly understood that any number of padlocks may be used on the multiple padlocking device 10 as may be accommodated by the rotatable plate 28.

I claim:

1. A multiple padlock device which allows entrance through a gate of a fence by removing any one of a number of padlocks, said device comprising:

stationary axis mounted on said gate in a substantially horizontal position;

plate means substantially perpendicular to and rotatable on said stationary axis, said plate means having a fixed number of unlocking holes a given distance from said stationary axis;

covering means pivotally mounted on said plate means for pivotally covering said fixed number of unlocking holes, padlocks at least equalling said fixed number of unlocking holes, said padlocks being connectable through openings in said plate means and said covering means to hold said covering means over said fixed number of unlocking holes;

locking bar slidable through a member of said gate with a first end engaging a member of said fence, a second end of said locking bar abutting said plate means said given distance from said stationary axis;

removal of one of said padlocks allowing said covering means to be pivoted so that said locking bar may slide through one of said unlocking holes which was uncovered by said covering means to disengage said fence member.

2. The multiple padlock device as given in claim 1 wherein said covering means are individual bars equal in number to said unlocking holes, each bar covering a separate unlocking hole in said plate means.

3. The multiple padlock device as given in claim 2 wherein each of said bars are pivotally pinned on said plate means near said stationary axis.

4. The multiple padlock device as recited in claim 1 wherein said plate means has at least three sets of holes therein along different radii, said radii being equal to said fixed number of unlocking holes, a first of said sets of holes being said unlocking holes, a second said sets of holes containing a pin means for said pivotal mounting of said bars, a third set of said holes being said openings for said padlocks.

5. The multiple padlocking device as recited in claim 4 wherein said plate means is secured to a sleeve means, said sleeve means being rotatable on said stationary axis.

6. A multiple padlock device which allows entrance through a gate for an opening in a wall by removing any one of a number of padlocks, said device comprising:

stationary axis mounted on said wall in a substantially horizontal position;

plate means substantially perpendicular to and rotatable on said stationary axis, said plate means having a fixed number of unlocking holes a given distance from said stationary axis;

covering means pivotally mounted on said plate means for pivotally covering said fixed number of unlocking holes, padlocks being of sufficient number to hold said covering means over said fixed number of unlocking holes, said padlocks being connectable through said plate means and said covering means to hold said covering means over said fixed number of unlocking holes;

locking bar slideable through a member of said wall with a first end engaging a member of said gate, a second end of said locking bar abutting said plate means said given distance from said stationary axis;

removal of one of said padlocks allowing said covering means to be pivoted so that said locking bar may slide through one of said unlocking holes which was uncovered by said covering means to disengage said locking bar from said gate member.

7. The multiple padlock device as given in claim 6 wherein said covering means are individual bars equal in number to said unlocking holes, each bar covering a separate unlocking hole in said plate means.

8. The multiple padlock device as given in claim 7 wherein each of said bars are pivotally pinned on said plate means near said stationary axis.

9. The multiple padlock device as recited in claim 6 wherein said plate means has at least three sets of holes therein along different radii, said radii being equal to said fixed number of unlocking holes a first of said sets of holes being said unlocking holes, a second said sets of holes containing a pin means for said pivotal mounting of said bars, a third set of said holes being said openings for said padlocks.

10. The multiple padlocking device as recited in claim 9 wherein said plate means is secured to a sleeve means, said sleeve means being rotatable on said stationary axis.

* * * * *